US006557508B2

(12) United States Patent
Labarge et al.

(10) Patent No.: US 6,557,508 B2
(45) **Date of Patent: *May 6, 2003**

(54) ROBUST TORCH JET SPARK PLUG ELECTRODE

(75) Inventors: William J. Labarge, Bay City, MI (US); Kaius Kiiren Polikarpus, Grand Blanc, MI (US); Keith Michael Brenske, Flushing, MI (US)

(73) Assignee: Savage Enterprises, Inc., Edina, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/740,579

(22) Filed: Dec. 18, 2000

(65) Prior Publication Data

US 2002/0112687 A1 Aug. 22, 2002

(51) Int. Cl.[7] ..... H01T 21/02; F02B 19/00

(52) U.S. Cl. ..... 123/169 EL; 123/266; 123/169 R; 313/141; 313/143

(58) Field of Search ..... 123/169 EL, 169 R, 123/143 A, 143 R, 266, 169 E; 313/140, 141, 142, 143, 144; 445/7

(56) References Cited

U.S. PATENT DOCUMENTS

| | | | | | |
|---|---|---|---|---|---|
| 3,903,453 | A | * | 9/1975 | Nishiro | 313/118 |
| 4,400,643 | A | * | 8/1983 | Nishio et al. | 313/141 |
| 4,514,657 | A | | 4/1985 | Igashira et al. | 313/141 |
| 4,924,829 | A | | 5/1990 | Cheng et al. | 123/266 |
| 5,405,280 | A | | 4/1995 | Polikarpus et al. | 445/7 |
| 5,421,300 | A | | 6/1995 | Durling et al. | 123/266 |
| 6,160,342 | A | * | 12/2000 | Nishikawa et al. | 313/141 |
| 6,334,800 | B1 | * | 1/2002 | Nishikawa et al. | 445/7 |

* cited by examiner

*Primary Examiner*—Hieu T. Vo
(74) *Attorney, Agent, or Firm*—Moore, Hansen & Sumner

(57) ABSTRACT

A composition for forming an electrode for use in a torch jet spark plug is provided. The composition comprises a ceramic material, ceramic particles, and an electrically conductive material. The ceramic particles are dispersed within the ceramic material. At least some of the ceramic particles have a predetermined size. This predetermined size is at least as large as the thickness of the finally formed electrode. The electrically conductive material is capable of being manipulated to form ribbons around the ceramic particles and of being sintered to form the electrode. The resultant electrode has good resistance to explosive erosion mechanisms, which consequently increases the life of the torch jet spark plug.

25 Claims, 1 Drawing Sheet

ROBUST TORCH JET SPARK PLUG ELECTRODE

FIELD OF THE INVENTION

The invention relates, in general, to torch jet spark plugs for use within a main combustion chamber of an internal combustion engine. More particularly, the invention relates to a durable, coarse particle electrode for a torch jet spark plug.

BACKGROUND OF THE INVENTION

The following background information is provided to assist the reader to understand the environment in which the invention will typically be used. The terms used herein are not intended to be limited to any particular narrow interpretation unless specifically stated otherwise in this document.

A spark plug is a device, inserted into the combustion chamber of an engine, containing a side electrode and an insulated center electrode spaced to provide a gap for firing an electrical spark to ignite air-fuel mixtures. The high-voltage burst from the coil via the distributor is received at the spark plug's terminal and conducted down a center electrode protected by an insulator. At the bottom of the plug, which projects into the cylinder, the voltage must be powerful enough to jump a gap between the center and side electrodes through a thick atmosphere of fuel mixture. When the spark bridges the gap, it ignites the fuel in the cylinder.

An alternative to spark ignition known in the art is torch jet-assisted spark ignition which, as taught by U.S. Pat. No. 4,924,829 to Cheng et al., U.S. Pat. No. 5,405,280 to Polikarpus et al. and U.S. Pat. No. 5,421,300 to Durling et al., offers several advantages over spark ignition approaches. Torch jet-assisted spark ignition employs a jet of burning gases that is propelled into the combustion chamber to increase the burning rate within the combustion chamber by providing increased turbulence as well as presenting a larger flame front area. As a result of a faster burning rate, lower cyclic variation in cylinder pressure is achieved, which enables a higher engine efficiency with a higher compression ratio.

In a torch jet-assisted spark ignition system, the jet typically emanates from a combustion prechamber, and passes through an orifice into the main combustion chamber. Though an air/fuel mixture can be introduced directly into the prechamber through a separate intake valve or fuel injector, it is generally preferable that the air/fuel mixture originate from the main chamber in order to simplify the construction of the engine and its ignition system. Furthermore, combustion of the air/fuel mixture within the prechamber can be initiated from within by a separate igniter, or can be initiated by the flame from within the main chamber. With either approach, combustion typically proceeds relatively simultaneously in both the prechamber and the main chamber. Because of the small relative volume of the prechamber, however, a high pressure is developed in the prechamber while the pressure is still relatively low in the main chamber. As a result, a jet of burning gases shoots from the prechamber far into the main chamber, and thereby significantly increases the combustion rate in the main chamber.

Currently used torch jet spark plugs, as taught by Durling et al., comprise a combustion prechamber on whose surface an inner electrode is formed. This inner electrode is formed by depositing a metal paste, such as a platinum or palladium metal paste, on the internal surface of the prechamber while the insulator body is in a green state prior to firing. During firing, the carrier component of the metal paste is dissipated, and the metal component wets and adheres to the internal surface of the prechamber to form a metal layer having a thickness of preferably about 0.01 to about 0.6 millimeters.

Polikarpus et al. teach an integrated molding and inking process for forming the inner electrode for the torch jet spark plug. This inner electrode is formed by the application of a metal ink to an outer surface of an elongated mandrel such that the metal ink forms a coating on the mandrel. The mandrel is then inserted into a suitable mold and the mold is filled with a substantially dry ceramic powder such that the powder envelopes the coating on the mandrel. The dry ceramic powder is then compacted so as to densify the dry ceramic powder and thereby form a "green" ceramic blank.

An ideal spark plug will always spark between 20,000–25,000 volts. Lower sparking voltages means decreased burn rate, high fuel consumption, and higher emissions. Higher sparking voltages around 30,000 volts or higher, leads to breakdown of the electrical system, spark plug wires, etc. Higher sparking also causes higher radio noise and radio frequency interference. During testing, the plugs produced by the Durling et al. and the Polikarpus et al. techniques did not perform as desired, often failing to meet the minimum desired 100 hours of accelerated testing. Thus, the typical life span of these spark plugs is approximately 10,000–30,000 miles. One of the factors leading to this premature failure appears to be deposits from the engine such as calcium phosphate at the tip. Another factor appears to be the quick erosion of the electrode due to the abrasive forces caused by "explosions" in the chamber. Electrode wear can cause premature spark plug failure and the voltage necessary for "sparking" may reach unacceptable levels.

There is a need in the industry to increase the durability of the spark plug electrode and to minimize the amount of electrode wear due to abrasive forces. A reduction in electrode wear would consequently increase the life span of the spark plug to greater than the 10,000–30,000 mile life currently achieved.

OBJECTIVES OF THE INVENTION

It is, therefore, an objective of the invention to provide a torch jet spark plug having a durable electrode which has good resistance to explosive erosion mechanisms.

A further objective is to produce a torch jet spark plug having an electrode which has a rough surface that creates a stagnant boundary layer near the electrode surface to reduce spark erosion.

Another objective is to provide a torch jet spark plug having a life span greater than those currently on the market.

Yet another objective is to produce a torch jet spark plug having a life span of approximately 60,000 miles or greater.

In addition to the objectives and advantages listed above, various other objectives and advantages of the invention will become more readily apparent to persons skilled in the relevant art from a reading of the detailed description section of this document. The other objectives and advantages will become particularly apparent when the detailed description is considered along with the drawings and claims presented herein.

SUMMARY OF THE INVENTION

The foregoing objectives and advantages are attained by the various embodiments of the invention summarized below.

A composition for forming an electrode for use in a torch jet spark plug is provided wherein the composition comprises a ceramic material, ceramic particles dispersed within the ceramic material wherein at least some of the ceramic particles have a predetermined size which is at least as large as the thickness of the finally formed electrode, and an electrically conductive material capable of being manipulated to form ribbons around the ceramic particles and sintered to form the electrode.

A method of forming the electrode is also provided. The method comprises several steps. The initial step involves injecting the electrode composition within a ceramic insulator body of the spark plug to deposit an electrode layer therein. The electrode layer and the ceramic insulator body are then co-fired so that the electrically conductive material sinters to form a conductive electrode embedded within the ceramic insulator body. The electrically conductive material also forms ribbons around the ceramic particles so as to produce an electrode resistant to explosive erosion mechanisms, which consequently increases the life of the torch jet spark plug.

BRIEF DESCRIPTION OF THE DRAWINGS

The figure is a cross-sectional view of one type of a torch jet spark plug including, according to the invention, the coarse particle electrode.

DETAILED DESCRIPTION OF THE INVENTION

Figure 1:
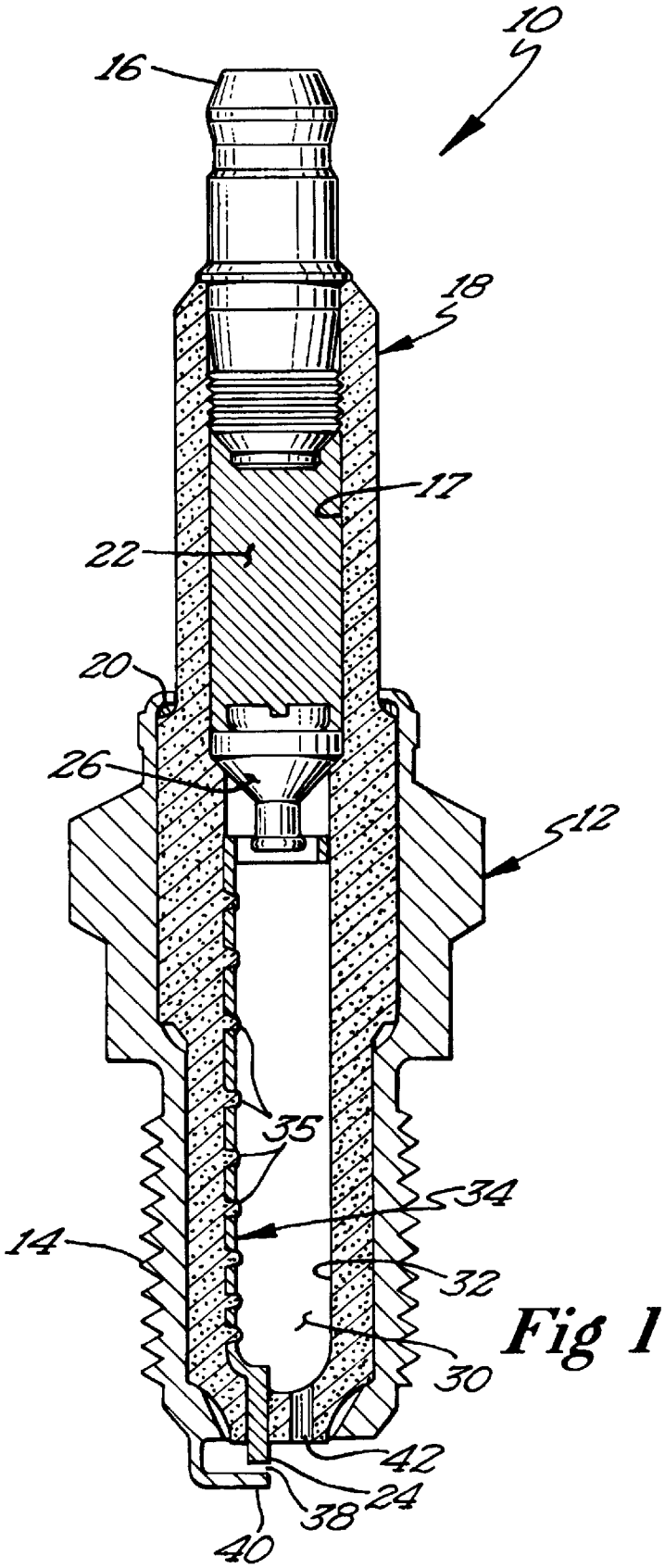

The figure depicts an example of one type of a torch jet spark plug 10 including a coarse particle electrode 34 according to the invention. As with spark plugs typically used with internal combustion engines, the spark plug 10 includes a shell 12 formed from steel, such as SAE 1008. External threads 14 are formed at one end of the shell 12 for the purpose of installing the spark plug 10 into a threaded hole in a wall of a combustion chamber within an internal combustion engine (not shown). An insulator body 18 formed from a ceramic material, such as alumina ($Al_2O_3$), is secured within the shell 12. A gasket 20 of a suitable temperature resistant material, such as copper or soft steel, is provided between the shell 12 and the insulator body 18 to create a gas tight seal therebetween. The insulator body 18 projects through the end of the shell 12 opposite the threads 14. The portion of the body 18 which projects from the shell 12 has a passage 17 which receives an upper terminal 16, by which an electric current can be supplied to the spark plug 10. Located at the end of the spark plug 10 opposite the upper terminal 16 is a ground terminal 40.

An electric current introduced at the upper terminal 16 is conducted to the ground terminal 40 through a resistor material 22 disposed in the passage 17 in the insulator body 18 and a series of intermediate electrodes disposed in a chamber, or prechamber 30, formed within the insulator body 18. The series of electrodes include an upper electrode 26 which projects into the prechamber 30 from passage 17, an inner electrode 34, which is disposed on the internal surface 32 of the prechamber 30, and an outer electrode 24 located adjacent an orifice 42 in the prechamber 30. The outer electrode 24 is a metal wire which projects through the lower wall of the prechamber 30 so as to form an outer spark gap 38 with the ground terminal 40.

The prechamber 30 is preferably elongated and extends along the longitudinal axis of the insulator body 18, such that the upper electrode 26 projects into an upper end of the prechamber 30 while the orifice 42 is disposed at a lower end. The orifice 42 serves to vent the prechamber 30 to the main combustion chamber of the engine in which the spark plug 10 is installed.

The coarse particle electrode 34 of the invention is disposed on the internal surface 32 of the prechamber 30. This coarse particle electrode 34 is made from a composition comprising a ceramic material, ceramic particles dispersed within this ceramic material, and an electrically conductive material. The electrically conductive material preferably is in particle and/or solids form. At least some of the ceramic particles have a predetermined size, as shown by element 35 which are at least as large as the thickness of the finally formed electrode 34. Upon firing, the ceramic particles bond and/or become anchored to the tubular insulator body 18. The electrically conductive solids form ribbons around the anchored ceramic particles. These electrically conductive solids also sinter together to form the electrode.

The ceramic material used in the composition is preferably a highly porous gamma alumina material and the ceramic particles are also preferably gamma alumina particles. The predetermined size of these alumina particles is approximately 10 $\mu$m or larger. It is preferable that the electrode composition comprises at least 20 weight percent of these alumina particles having a size of approximately 10 $\mu$m or larger.

A platinum material in particle form is the preferred electrically conductive material. Other different metal particles, however, may by used and/or incorporated into the electrode composition. An alternative formulation to pure platinum is a 90% platinum and 10% rhodium particle formulation. Other alternative formulations include 75% palladium and 25% platinum; 100% gold; and 60% silver and 40% palladium.

The electrode composition may also contain ceramic materials other than alumina. One such formulation used 50 volume % platinum and 50 volume % zirconia ($ZrO_2$). Another formulation contained 30 volume % silver, 20 volume % palladium, and 50 volume % magnesium aluminate-spinel ($MgAl_2O_3$).

The composition is dispersed/suspended in a liquid carrier material. Mixtures of liquids can be used to control the rate of deposition of the electrode. Thin liquids such as ethanol deposit the electrode composition very quickly because the ethanol rapidly absorbs into the bisque fired ceramic. Viscous liquids such as terpineol absorb very slowly into the bisque fired ceramic. The thickness of the electrode is determined by how fast the liquids are absorbed by the bisque ceramic part, how long the part is exposed to the composition, and the concentration of the conductive material and the ceramic particles in the composition.

The composition may also include a binder, such as an acrylic binder. The use of an acrylic binder in the composition leaves a deposited electrode layer that cannot be rubbed off by hand. Without the use of this binder, the deposited layer can be too soft to withstand processing.

Also, fugitive materials may be included in the composition. These fugitive materials may be carbon, graphite or other types of non-dissolved organic materials which will occupy space until the electrode is fired. Upon firing, these materials will leave open porosity in the fully fired electrode.

The electrodes may be formed from any one of a variety of compositions. Below are three preferred formulations, the first of which has been determined to produce the best results.

EXAMPLE 1 a) 9.0 grams Condea Vista SCFA-100 gamma alumina
b) 21.0 grams Degussa H-7000 platinum powder
c) 20.0 grams ethanol
d) 5.0 grams terpineol
e) 25.0 grams xylene

EXAMPLE 2 a) 9.0 grams Condea Vista SCFA-100 gamma alumina
b) 21.0 grams Degussa platinum/rhodium flake 90/10
c) 20.0 grams ethanol
d) 5.0 grams terpineol
e) 25.0 grams xylene

EXAMPLE 3 a) 9.0 grams Alcoa A-16 SG alpha alumina
b) 21.0 grams Degussa H-7000 platinum powder
c) 20.0 grams ethanol
d) 34.0 grams terpineol
e) 5.0 grams cellulose ethylether resin
f) 5.0 grams butyl acetate A spark plug fails when the voltage necessary to initiate a spark increases over 25,000 to 30,000 volts. The electrical system cannot supply more voltage than approximately 30,000 volts. The following table compares the voltage capabilities of spark plugs having different types of electrodes. Note that some of the plugs produced a spark with 33,000 and 32,000 volts but the spark was irregular so that plugs were considered to have failed. The others "failed" because a spark no longer occurred and thus the demand voltage could not be measured.

| Demand Voltage | New | 100 Hour | 200 Hour | 300 Hour | 400 Hour |
|---|---|---|---|---|---|
| Standard platinum tip plug | 16,000 | 18,000 | 22,000 | 22,000 | failed |
| Torch jet by inked spindle | 15,000 | 33,000 (failed) | 32,000 (failed) | failed | failed |
| Torch jet with Pt/alpha alumina | 16,000 | 23,000 | 25,000 | failed | failed |
| Torch jet with Pt/gamma alumina | 20,000 | 23,000 | 23,000 | 25,000 | 25,000 |

After 400 hours of testing, the torch jet spark plug utilizing the platinum with the gamma alumina continued to produce a spark within the voltage limit. The 400 hour test regimen, which is designed to accelerate the failure of the plug, means that the plug should last approximately 60,000 miles in real life. It will soon be necessary for the plug to last as long as all other equipment that effects vehicle emissions, which could be up to 120,000 miles. At this time, it is not feasible to perform a durability test for 120,000 miles. Testing, therefore, had to be terminated after 400 hours.

Note that the platinum/gamma alumina electrode stays within the desired sparking limits for the entire test of the plug. The standard plugs (with platinum tipped electrodes) are started lower than desired (determined by the spark plug "gap") so that they will last longer. The torch jet by inked spindle plug did not last the minimum desired 100 hours.

Another test was performed on the platinum/gamma alumina electrode. It was designed to measure the amount of electrode loss. It is desirable to reduce the amount of erosion of the electrode because as the electrode erodes away, the "gap" increases. As the gap increases, the demand voltage increases. Eventually, the gap becomes so large that there is not enough voltage available to allow the spark to jump the gap. Consequently, the spark plug fails. Before the test began, the electrode had approximately 30 mg of platinum. After 100 hours of testing, the electrode lost only 4 mg of platinum. After 400 hours, only 6 mg of platinum was lost. Thus, there was very little erosion of the electrode from 100 hours to 400 hours.

The method of forming the coarse particle electrode of the invention comprises several steps. One step involves injecting the above described electrode composition into the prechamber 30 of the ceramic insulator body 18 to deposit an electrode layer 34 on the internal surface 32 of the prechamber 30. The electrode layer 34 and the ceramic insulator body 18 are then co-fired at approximately 1600° C. so as to cause the electrically conductive material in the electrode layer to sinter and embed the electrode layer 34 within the ceramic insulator body 18. The electrically conductive material also forms ribbons around the ceramic particles 35.

The presently preferred embodiment for carrying out the invention has been set forth in detail according to the Patent Act. Persons of ordinary skill in the art to which this invention pertains may nevertheless recognize various alternative ways of practicing the invention without departing from the spirit and scope of the following claims. Persons who possess such skill will also recognize that the foregoing description is merely illustrative and not intended to limit any of the ensuing claims to any particular narrow interpretation.

Accordingly, to promote the progress of science and the useful arts, we secure for ourselves by Letters Patent exclusive rights to all subject matter embraced by the following claims for the time prescribed by the Patent Act.

What is claimed is:

1. A torch jet spark plug including a coarse particle electrode resistant to explosive erosion mechanisms, said torch jet spark plug comprising:

(a) a ceramic insulator body; and (b) an electrode embedded within said ceramic insulator body, said electrode being formed from a composition including:

(i) a ceramic material;

(ii) ceramic particles dispersed within said ceramic material, at least some of said ceramic particles having a predetermined size which is at least as large as the thickness of the electrode; and (iii) an electrically conductive material capable of being manipulated to form ribbons around said ceramic particles and sintering together to form said electrode.

2. A torch jet spark plug including a coarse particle electrode as recited in claim 1 wherein said ceramic material is a highly porous gamma alumina material.

3. A torch jet spark plug including a coarse particle electrode as recited in claim 1 wherein said ceramic particles are alumina particles and said predetermined size is approximately 10 $\mu$m or larger.

4. A torch jet spark plug including a coarse particle electrode as recited in claim 3 wherein said alumina particles having said predetermined size of approximately 10 μm or larger comprise at least 20 weight percent of solids within said composition.

5. A torch jet spark plug including a coarse particle electrode as recited in claim 1 wherein said electrically conductive material comprises a platinum material.

6. A torch jet spark plug including a coarse particle electrode as recited in claim 1 wherein said composition further includes a liquid carrier material.

7. A torch jet spark plug including a coarse particle electrode as recited in claim 1 wherein said composition further includes a binder.

8. A torch jet spark plug including a coarse particle electrode as recited in claim 1 wherein said composition further includes fugitive materials such as non-dissolved organic materials which are capable of leaving open porosity in a fully fired electrode.

9. A composition for forming an electrode for use in a torch jet spark plug, said composition comprising:

(a) a ceramic material;

(b) ceramic particles dispersed within said ceramicmaterial, at least some of said ceramic particles having a predetermined size which is at least as large as the thickness of the electrode; and (c) an electrically conductive material capable of being manipulated to form ribbons around said ceramic particles and sintering to form said electrode.

10. A composition as recited in claim 9 wherein said ceramic material is a highly porous gamma alumina material.

11. A composition as recited in claim 9 wherein said ceramic particles are alumina particles and said predetermined size is approximately 10 μm or larger.

12. A composition as recited in claim 11 wherein said alumina particles having said predetermined size of approximately 10 μm or larger comprise at least 20 weight percent of solids within the material.

13. A composition as recited in claim 9 wherein said electrically conductive material comprises a platinum material.

14. A composition as recited in claim 9 further including a liquid carrier material.

15. A composition as recited in claim 9 further including a binder.

16. A composition as recited in claim 9 further including fugitive materials such as non-dissolved organic materials.

17. A method of forming a coarse particle electrode resistant to explosive erosion mechanisms for use in a long life torch jet spark plug, such torch jet spark plug including a ceramic insulator body, said method comprising the steps of:

(a) providing a composition including a ceramic material, ceramic particles dispersed within said ceramic material, at least some of said ceramic particles having a predetermined size which is at least as large as the thickness of the electrode, and an electrically conductive material;

(b) injecting said composition within said ceramic insulator body to deposit an electrode layer within said ceramic insulator body; and (c) co-firing said electrode layer and said ceramic insulator body such that said electrically conductive material sinters to form a conductive electrode embedded within said ceramic insulator body and forms ribbons around said ceramic particles so as to produce an electrode resistant to explosive erosion mechanisms consequently increasing the life of the torch jet spark plug.

18. A method of forming a coarse particle electrode as recited in claim 17 wherein said ceramic material is a highly porous gamma alumina material.

19. A method of forming a coarse particle electrode as recited in claim 17 wherein said ceramic particles are alumina particles and said predetermined size is approximately 10 μm or larger.

20. A method of forming a coarse particle electrode as recited in claim 19 wherein said alumina particles having said predetermined size of approximately 10 μm or larger comprise at least 20 weight percent of solids within said mixture.

21. A method of forming a coarse particle electrode as recited in claim 17 wherein said electrically conductive material comprises a platinum material.

22. A method of forming a coarse particle electrode as recited in claim 17 including the step of suspending said composition into a liquid carrier material which aids in depositing said composition onto an inner surface of the ceramic insulator body and which subsequently becomes absorbed into the ceramic insulator body.

23. A method of forming a coarse particle electrode as recited in claim 17 wherein said composition further includes a binder.

24. A method of forming a coarse particle electrode as recited in claim 17 wherein said composition further includes fugitive materials such as non-dissolved organic materials which will occupy space in said composition until said electrode is fired and consequently leave open porosity in a fully fired electrode.

25. A method of forming a coarse particle electrode as recited in claim 17 wherein said electrode layer and said ceramic insulator body are co-fired at approximately 1600° C.

* * * * *